US006350349B1

(12) United States Patent
Hermans et al.

(10) Patent No.: US 6,350,349 B1
(45) Date of Patent: Feb. 26, 2002

(54) METHOD FOR MAKING HIGH BULK WET-PRESSED TISSUE

(75) Inventors: Michael Alan Hermans, Neenah; Charles Edward Friedbauer, Appleton, both of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 841 days.

(21) Appl. No.: 08/644,555

(22) Filed: May 10, 1996

(51) Int. Cl.[7] ..... D21H 11/20; B31F 1/12

(52) U.S. Cl. ..... 162/111; 162/112; 162/113; 162/146; 162/157.6; 162/205; 162/206

(58) Field of Search ..... 162/109, 100, 162/9, 111, 112, 113, 205, 206, 358.3, 146, 157.6

(56) References Cited

U.S. PATENT DOCUMENTS

| | | | | |
|---|---|---|---|---|
| 4,551,199 A | * | 11/1985 | Weldon | 162/111 |
| 4,849,054 A | * | 7/1989 | Klowak | 162/113 |
| 4,973,384 A | | 11/1990 | Crouse et al. | 162/359 |
| 5,225,047 A | | 7/1993 | Graef et al. | 162/9 |
| 5,252,275 A | | 10/1993 | Sultze et al. | 264/119 |
| 5,324,391 A | | 6/1994 | Carney et al. | 162/9 |
| 5,324,575 A | | 6/1994 | Sultze et al. | 428/224 |
| 5,348,620 A | | 9/1994 | Hermans et al. | 162/9 |
| 5,393,384 A | * | 2/1995 | Steiner et al. | 162/358.3 |
| 5,399,240 A | | 3/1995 | Graef et al. | 162/9 |
| 5,437,418 A | | 8/1995 | Graef et al. | 241/65 |
| 5,556,511 A | * | 9/1996 | Bluhm et al. | 162/111 |

FOREIGN PATENT DOCUMENTS

| | | | | |
|---|---|---|---|---|
| EP | 0675 225 | | 4/1995 | |
| GB | 1212473 | * | 11/1970 | 162/109 |
| WO | WO 95/00706 A1 | | 1/1995 | D21H/27/30 |
| WO | 95/16821 | | 6/1995 | |
| WO | 95/17548 | | 6/1995 | |
| WO | 95/26440 | | 10/1995 | |

OTHER PUBLICATIONS

Patent Cooperation Treaty Search Report from the International Search Authority, International Application No. PCT/US 97/06695 dated Oct. 1, 1997.

* cited by examiner

*Primary Examiner*—Peter Chin
(74) *Attorney, Agent, or Firm*—Gregory E. Croft

(57) ABSTRACT

Cellulosic webs, such as tissue webs, can be dewatered to consistencies of about 70 percent or greater in a high intensity extended nip press while retaining a substantial amount of bulk. While webs intended for use as tissues containing conventional furnishes become overly densified when passed through a high intensity extended nip press, furnishes containing certain types of fibers, such as chemically cross-linked or heat-treated fibers, resist compression and allow the compressed web to retain a high level of bulk after a high degree of dewatering.

21 Claims, 3 Drawing Sheets

METHOD FOR MAKING HIGH BULK WET-PRESSED TISSUE

BACKGROUND OF THE INVENTION

In the manufacture of tissue products, such as facial tissue, bath tissue, paper towels and the like, the tissue sheet is formed by depositing an aqueous suspension of papermaking fibers onto a forming fabric. The web is then transferred to a papermaking felt and dewatered as it passes through a pressure nip created between a pressure roll and a Yankee dryer as the wet web is transferred to the Yankee surface. Free water expressed from the web in the pressure nip is absorbed and carried away by the felt as the web transfers to the Yankee surface. The web is then final dried on the surface of the Yankee and subsequently creped to impart bulk and softness to the resulting tissue sheet. This method of making tissue sheets is commonly referred to as "wet-pressing" because of the method used to dewater the wet web.

The wet-pressing method has a couple of distinct drawbacks. First, pressing the tissue web while wet densifies the web significantly. As the web is dried, the dried sheet retains this high density (low bulk) until it is creped. Creping is necessary to attempt to undo what the wet-pressing has done to the sheet. In response to this situation, through-air-drying methods have been developed in which the newly-formed web is partially dewatered to about 30 percent consistency using vacuum suction. Thereafter the partially dewatered web is final dried without compression by passing hot air through the web while it is supported by a throughdrying fabric. However, through-air-drying is expensive in terms of capital and energy costs.

A second drawback, shared by conventional wet-pressing and through-air-drying processes is the high energy costs necessary to dry the web from a consistency of about 35 percent to a final dryness of about 95 percent. This second drawback has recently been addressed in the manufacture of high density paper products by the advent of the high intensity extended nip press. This device employs an extended nip length and heat to more efficiently dewater the wet web up to exit consistencies of about 60 percent. Such devices have been successfully used for making paperboard, but have not been used to make low density paper products such as tissues because the high pressures and longer dwell times in the extended nip press serve to further densify the sheet beyond that experienced by conventional tissue wet-pressing methods. This increase in density is detrimental to the quality of the resulting tissue products because creping cannot completely overcome the added increase in sheet density.

Therefore there is a need for a method of making wet-pressed tissue sheets that minimizes or eliminates the high densities imparted to wet-pressed tissue webs.

SUMMARY OF THE INVENTION

It has now been discovered that the reduction in bulk associated with wet-pressing can be substantially reduced by incorporating into the web certain fibers which have been found to greatly diminish web densification when subjected to the high pressures necessary for dewatering with high intensity extended nip presses. As a consequence, high intensity extended nip presses can be used to dewater tissue webs without the heretofore adverse consequence of imparting a high degree of densification to the web.

Hence in one aspect the invention resides in a method for making a bulky tissue sheet comprising: (a) depositing an aqueous suspension of papermaking fibers onto a forming fabric to form a wet tissue web, said papermaking fibers comprising at least about 10 dry weight percent modified wet-resilient fibers; (b) partially dewatering the wet web to a consistency of about 15 percent or greater; (c) compressing the partially dewatered web in a high intensity extended nip press to further dewater the web to a consistency of about 35 percent or greater; and (d) final drying the web, wherein the Bulk of the dewatered web prior to final drying is greater than (−0.02C+3.11), wherein "C" is the consistency of the web leaving the high intensity extended nip press, expressed as percent dryness, and Bulk is expressed as cubic centimeters per gram. For a given consistency, the wet tissue webs of this invention have greater bulk than comparable wet tissue webs that have been dewatered by conventional means. Furthermore, the consistency can be increased well beyond that attainable by conventional tissue dewatering and, in most instances, still have a higher bulk at higher consistencies than that of conventional wet tissue webs at substantially lower consistencies.

In another aspect, the invention resides in the combination of dewatering a tissue web using a high intensity extended nip press, which greatly reduces the bulk of the tissue web, followed by rush transferring the dewatered web to increase the bulk of the web back to levels suitable for tissue. More specifically, the invention resides in a method for making a bulky tissue sheet comprising: (a) depositing an aqueous suspension of papermaking fibers onto a forming fabric to form a wet tissue web; (b) partially dewatering the wet web to a consistency of about 15 percent or greater; (c) compressing the partially dewatered web in a high intensity extended nip press to further dewater the wet web to a consistency of about 35 percent or greater; (d) transfering the dewatered web to a first transfer fabric; (e) transfering the dewatered web from the first transfer fabric to a second transfer fabric travelling at a slower speed than the first transfer fabric (rush transfer) to increase the bulk of the wet web; and (f) drying the web. The web can be dried on a Yankee dryer and creped, or the web can be throughdried and left uncreped or creped.

As used herein, "modified wet-resilient fibers" are fibers that have been modified from their natural state and have the capability to recover after deformation in the wet state, as opposed to fibers that remain deformed and do not recover after deformation in the wet state. Examples of modified wet-resilient fibers include, without limitation, chemically cross-linked cellulosic fibers, heat-cured cellulosic fibers, mercerized fibers and sulfonated pulp fibers. These fiber modification methods are well known in the art. The amount of modified wet-resilient fibers in the fiber furnish can be about 10 dry weight percent or greater, more specifically from about 20 to about 80 percent, and still more specifically from about 30 to about 60 percent. The bulk benefits associated with using modified wet-resilient fibers increase as the amount of the modified wet-resilient fibers increases. Consequently the amount used must take into account the desireability for added bulk versus other desired properties, such as tensile strength, that other fibers may be better suited to provide.

A "high intensity extended nip press", as used herein, is a water-removing pressing apparatus wherein the wet web is compressed in an extended nip formed between the arcuate surface of a backing roll and a pressing fabric or blanket. Typically the pressing fabric is supported by a press shoe having a concave surface. The backing roll can be heated to elevated temperatures or remain at ambient temperature. The length of the extended nip can be substantial, typically from about 5 to about 10 inches or more. Such devices permit the operator to vary conditions such as dwell time, pressure and temperature to effect greater water removal than can normally be obtained in a conventional roll press. Such an apparatus can remove substantially all of the free water in the sheet and a significant portion of the bound water as well. An example of such an apparatus is disclosed and described in U.S. Pat. No. 4,973,384 issued Nov. 27, 1990 to Crouse et al. entitled "Heated Extended Nip Press Apparatus", which is herein incorporated by reference. In operating the high intensity extended nip press, the use of a heated press roll in the extended nip is optional, although preferred for maximum water removal.

The consistency (weight percent fiber or percent dryness) of the partially dewatered web entering the high intensity extended nip press can be about 15 percent or greater, more specifically from about 15 to about 30 percent. The consistency of the web leaving the high intensity extended nip press can be about 35 percent or greater, more specifically from about 40 to about 70 percent, and still more specifically from about 50 to about 65 percent. The final consistency may depend upon the incoming web consistency, the speed of the web, the temperature of the heated roll, the pressure within the nip, the length of the nip, the properties of the fibers and the characteristics of the press felt, as well as additional variables.

Depending upon the consistency to which the web is dewatered and other factors, such as the temperature/pressure of the high intensity extended nip press and the dwell time in the nip, the Bulk of the wet web leaving the high intensity extended nip press can be from about 2.3 to about 3.5 cubic centimeters per gram or greater, more specifically from about 2.4 to about 3.0 cubic centimeters per gram. More specifically, taking the consistency of the web into account, the Bulk of the wet web leaving the high intensity extended nip press can be greater than (−0.02C+3.11), more specifically greater than (−0.032C+3.78), still more specifically greater than (−0.02C+3.52), and still more specifically greater than (−0.03C+4.28), where "C" is the consistency of the web. The origin of these values will be described in detail in reference to the Drawings. Stated differently, the increase in Bulk attained when using the high intensity extended nip press to dewater webs containing modified wet-resilient fibers is from about 5 to about 50 percent, more specifically from about 10 to about 40 percent, and still more specifically from about 20 to about 30 percent greater than the Bulk of webs consisting of a 50/50 weight percent blend of eucalyptus and northern hardwood kraft fibers produced under the same conditions.

As used herein, Bulk is determined by dividing the caliper of the web by the basis weight. The caliper is measured for a single web or sheet using a T.M.I. Model 549 micrometer (Testing Machines Inc., Amityvile, N.Y.) using a circular pressure foot having an area of 200 square millimeters. The pressure foot lowering speed is about 0.8 millimeters per second. The pressure, when lowered, is about 0.50 kilogram per square centimeter. The dwell time is about 3 seconds. One measurement is taken for each sheet and five sheets of each sample are tested. The readings are taken near the end of the dwell time for each test. The average of the five readings is the caliper of the sample.

In those embodiments of this invention in which a rush transfer is utilized after the web has been dewatered, the speed of the first transfer fabric (the fabric from which the web is being transferred) can be about 5 to about 35 percent faster than the speed of the second transfer fabric (the fabric to which the web is being transferred). More specifically, the speed differential can be from about 10 to about 30 percent, and still more specifically from about 20 to about 30 percent. As the speed differential is increased, the Bulk of the resulting web is increased. Speed differentials greater than about 35 percent, however, are not desirable because the sheet buckles to form macrofolds. dr

DETAILED DESCRIPTION OF THE DRAWING

Figure 1:
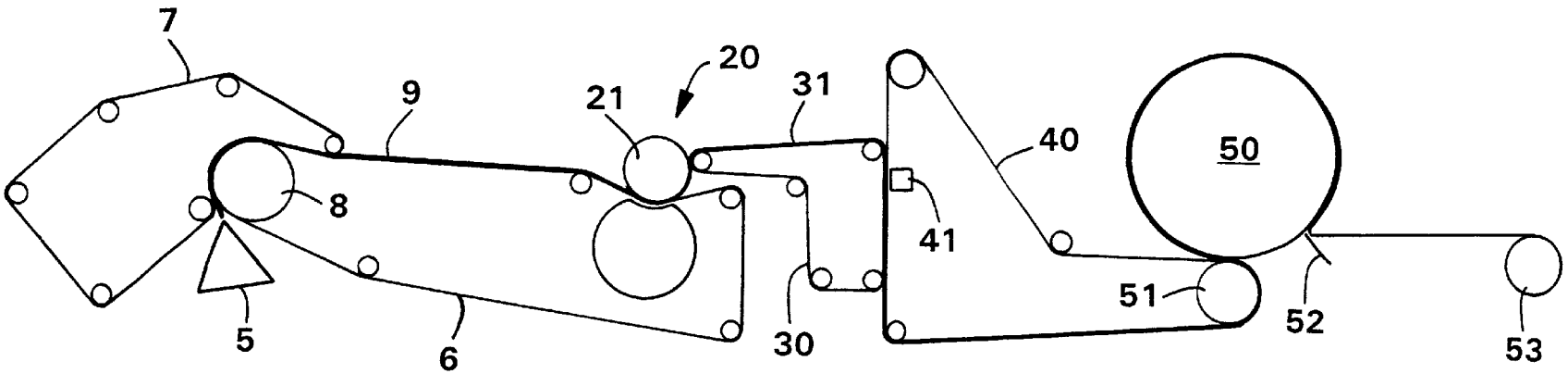
FIG. 1 is a schematic diagram of a tissue making process in accordance with this invention, illustrating the use of a high intensity extended nip press.

Referring to FIG. 1, shown is a schematic flow diagram of a tissue making process utilizing a high intensity extended nip press in accordance with this invention. Shown is a headbox 5 which deposits an aqueous suspension of papermaking fibers between a papermaking felt 6 and a forming fabric 7. Both fabrics converge and partially traverse the arc of the forming roll 8, after which the web 9 is retained by the felt. This forming geometry is commonly referred to as a crescent former. However, other forming configurations can also be used, such as twin wire formers. At this point in the process, the web typically will have a consistency of about 15 percent.

While supported by the felt, the wet web is then passed through the high intensity extended nip press 20 to further dewater the web to a consistency of from about 35 to about 70 percent. The dewatered web briefly transfers to the surface of the backing roll 21 of the high intensity extended nip press before being further transferred to a first transfer fabric 30.

The dewatered web 31 is then transferred to a second transfer fabric 40 with the aid of a vacuum box or transfer shoe 41. This transfer can optionally be a rush transfer, in which the second transfer fabric is travelling from about 5 to about 35 percent slower than the first transfer fabric in order to partially debond the web to soften it and introduce machine direction stretch. The web is thereafter applied to the surface of a Yankee dryer 50 using pressure roll 51 to final dry the web, which is thereafter creped with a doctor blade 52 and wound up into a roll 53.

It will be appreciated that other drying/creping options are also suitable in combination with high intensity extended nip press dewatering. For example, the dewatered web 31 can be rush transferred as described above and thereafter transferred to a throughdrying fabric and throughdried, with or without subsequent creping. Alternatively, the dewatered web 31 can be transferred to a Yankee dryer without a rush transfer and creped.

Figure 2:
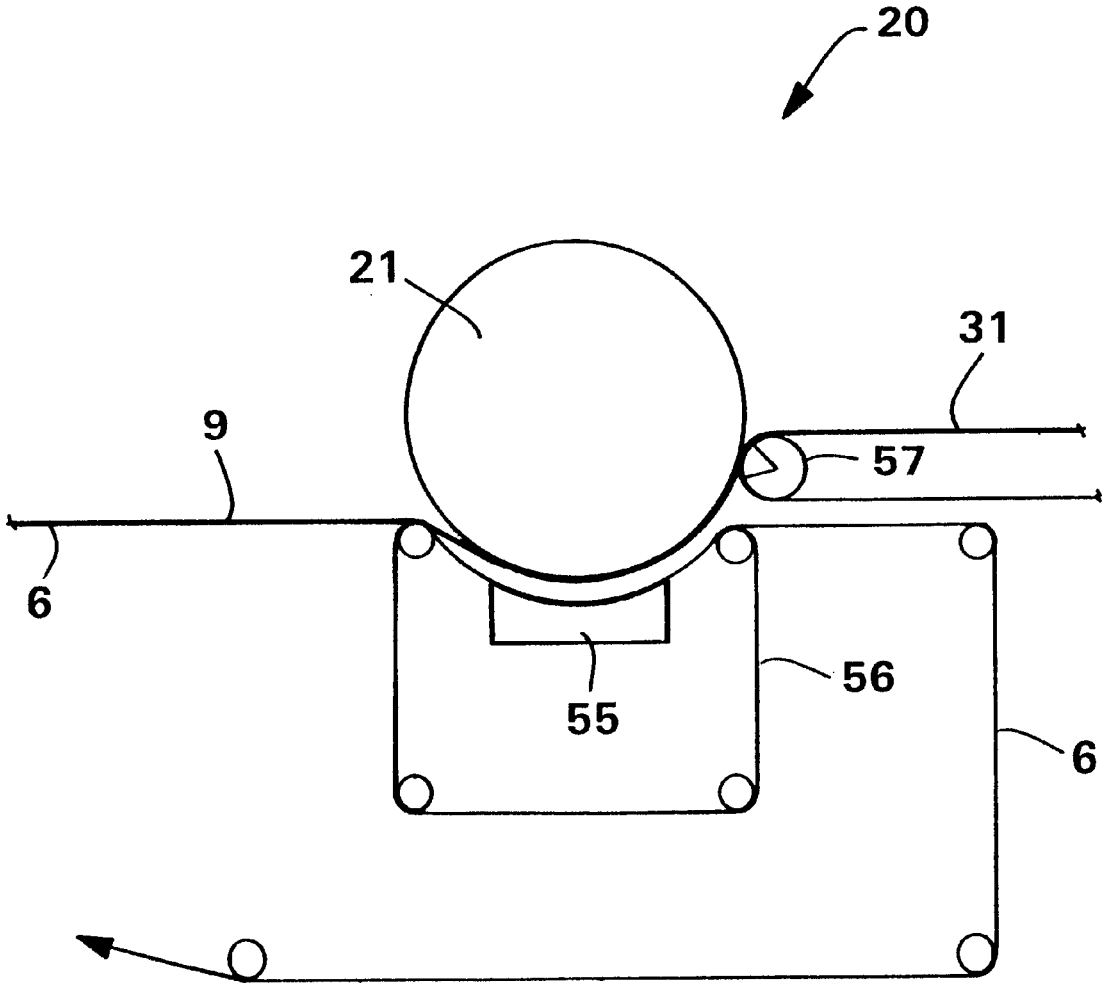
FIG. 2 is a schematic view of the high intensity extended nip press, illustrating its function in more detail.

FIG. 2 illustrates the high intensity extended nip press of FIG. 1 in more detail. Shown is the incoming web 9 supported by the felt 6 entering the high intensity extended nip press 20. The nip is formed between the backing roll 21 and a pressing fabric 56, which follows the concave contour of the press shoe 55. The tissue web is briefly transferred to the backing roll and thereafter transferred to a first transfer fabric 31 using a vacuum roll 57.

Figure 3:
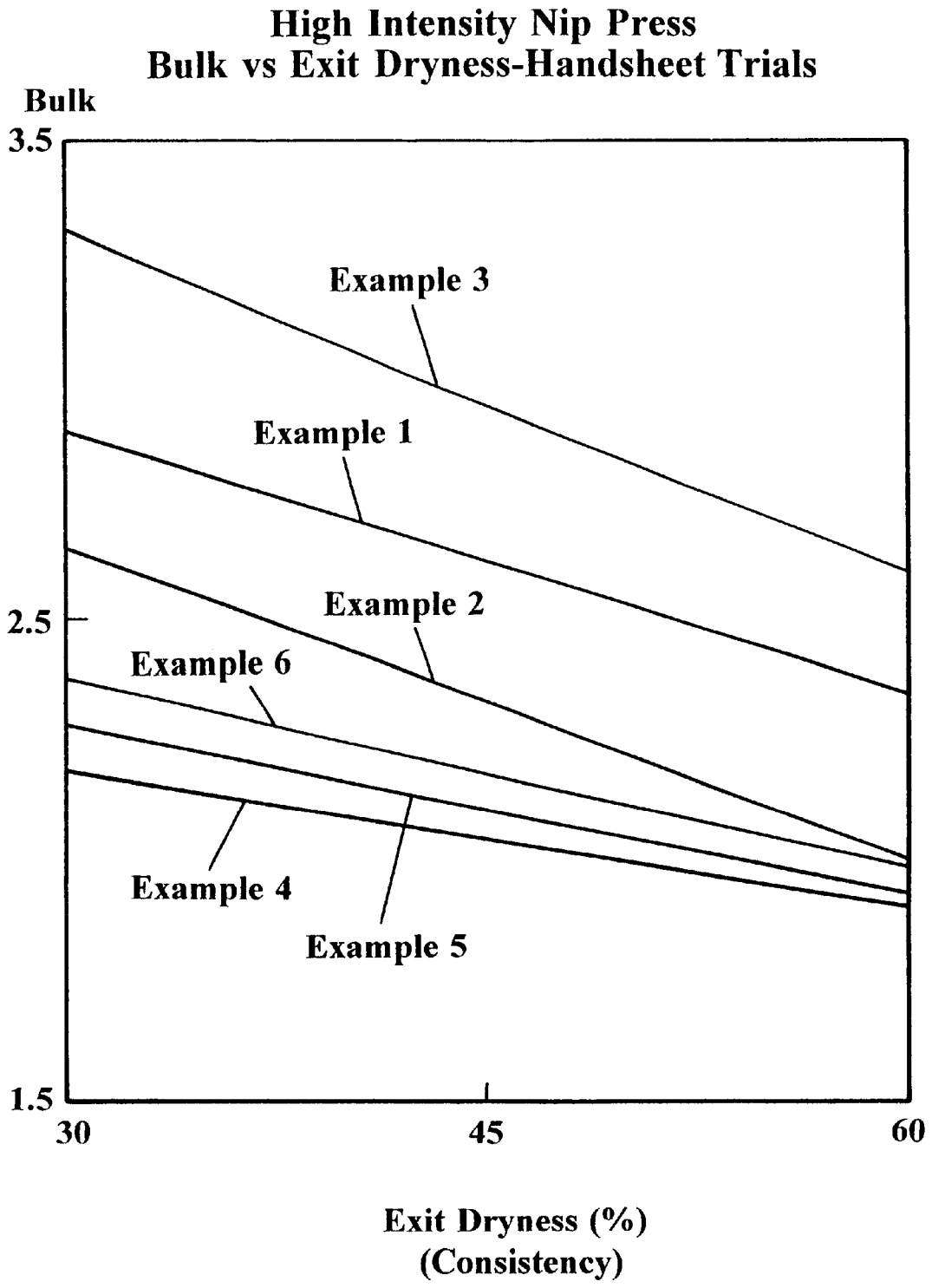
FIG. 3 is a plot of Bulk as a function of web consistency for handsheets produced under conditions simulating the operation of a high intensity extended nip press, illustrating the decrease in Bulk with increasing exit consistency for a number of different fiber furnishes.

FIG. 3 represents several plots of web Bulk versus consistency for handsheets prepared to simulate webs exiting the high intensity extended nip press and is discussed below in connection with the Examples.

EXAMPLES

Example 1

(Heat-cured Fibers)

Southern pine softwood kraft pulp (CR-54) was fiberized in a Pallman fiberizer, preconditioned to a moisture content of 5% and then heated in a convection oven at 200° C. for 20 minutes crosslink and curl the fibers. (A catalyst can be used to reduce the temperature and length of the treatment.) After treatment, the fibers had a water retention value (WRV) of 0.65 g/g and a curl index of 0.15 (measured via Fiber Quality Analyzer) versus a WRV of 1.2 g/g and a curl index of 0.09 before treatment. This fiber was combined in a 50/50 blend with eucalyptus kraft fiber that had been treated at high consistency and elevated temperature in a disperser in accordance with U.S. Pat. No. 5,348,620 issued Sept. 20, 1994 to Hermans et al. entitled "Method of Treating Papermaking Fibers for Making Tissues", which is herein incorporated by reference. More specifically, the eucalyptus fibers were dispersed in a Maule shaft disperser at a temperature of about 150° F. at a consistency of about 30 percent with a power input of about 1.5 horsepower per day per ton. The combined fiber furnish was then formed into handsheets and subjected to dewatering conditions designed to simulate the operation of a high intensity extended nip press.

More specifically, 25 grams of the softwood fibers and 25 grams of the hardwood fibers were combined with 2000 grams of distilled water in a British disintegrator and processed for 10 minutes. The appropriate amount of slurry, based on its consistency, to form a 25 GSM handsheet was poured into a standard square TAPPI handsheet mold. The handsheet formation followed standard TAPPI methods for tissue. The wet handsheet was couched off of the forming wire with only blotter paper and the slightest amount of pressure provided manually. Each wet handsheet and blotter paper were placed inside a sealable plastic bag, after which the blotter paper was carefully removed so as to not ruin the handsheet formation. Each individual handsheet was therefore stored in a sealable plastic bag at approximately 30% solids until they were to be tested on the high intensity nip apparatus.

In order to simulate dewatering in a high intensity extended nip press, two circles at a diameter of approximately 3 inches each were cut out of each handsheet. An individual circular handsheet was placed in a metal frame, which was a circular device consisting of a top and bottom half, each half having a pattern of strings intended to hold the handsheet in place during the test. Once in place in the frame, the handsheet was visually saturated with water via a common household spray gun. The frame was then placed on top of a pre-weighed circular felt section in a stationery holder below the movable high intensity nip platen. The platen then moved down and nipped the handsheet for a defined impulse before returning to its original position. This impulse was a replication of a production scale high intensity nip. The capabilities of the impulse can be controlled through the temperature of the platen, dwell time in the nip, and pressure. Temperatures in the nip ranged from 72° F. to 350° F. The dwell time for all tests was 25 milliseconds. A standard pressure profile was used as described in the Crouse et al. patent referenced above. The average pressure was about 600 psi. The pressed handsheets were then removed and weighed to determine the exiting consistency for each of the conditions tested.

Example 2

(Chemically Cross-linked Fibers)

Same as Example 1, except the southern pine softwood kraft fiber was treated in a disperser in accordance with U.S. Pat. No. 5,348,620 described above. The fiber was then blended with ammonium zirconium carbonate at a level of 1.2 pounds per pound and cured at 180° C. for 10 minutes. The well-blended pulp/crosslinker mixture was then fiberized in a Pallman fiberizer. This fiber was combined in a 50/50 blend with dispersed eucalyptus kraft fiber and made into handsheets and tested as described in Example 1.

Example 3

(Chemically Cross-linked Fibers)

Same as Example 1, except Weyerhauser High Bulk Additive pulp was substituted for the southern pine softwood kraft pulp fiber. This cellulose pulp is impregnated with a urea-formaldehyde crosslinker and cured at elevated temperature.

Example 4

(Conventional Tissue Making Fibers)

Handsheets were prepared and tested as described in Example 1, except the fibers used were a 50/50 blend of eucalyptus fibers and northern softwood kraft fibers.

Example 5

(Curled Fibers)

Handsheets were prepared and tested as described in Example 1, except the fibers used were a 50/50 blend of eucalyptus fibers and dispersed northern softwood kraft fibers. The northern softwood kraft fibers were dispersed under the same conditions as were the eucalyptus fibers as described in Example 1.

Example 6

(Conventional Tissue Making Fibers with Debonder)

Handsheets were prepared and tested as described in Example 1, except the fibers were a 50/50 blend of eucalyptus fibers and northern softwood kraft fibers to which 20 pounds per ton of fiber of a debonder had been added (Berocell 596, manufactured by Eka Nobel Inc.).

The results of these six examples is summarized in FIG. 3, which is a plot of the Bulk as a function of the consistency of the wet tissue sheet after being pressed under the conditions of the simulated high intensity extended nip press. As shown, a line relating bulk to exit consistency exists for each furnish tested in each of the Examples. In all cases bulk decreases as exit dryness is increased. The increase in bulk relative to the bottom "control" line represents the improvement due to the treatment of the fibers. It is especially noteworthy that the bulk of the modified wet-resilient fibers at 60 percent exit consistency is for the most part greater than the control at 40 percent consistency. This increase in bulk (or decrease in sheet density) allows the production of high quality tissue despite pressing to 60 percent consistency.

It will be appreciated that the foregoing examples, given for purposes of illustration, are not to be construed as limiting the scope of this invention, which is defined by the following claims and all equivalents thereto.

We claim:

1. A method for making a bulky tissue sheet comprising: (a) depositing an aqueous suspension of papermaking fibers onto a forming fabric to form a wet tissue web, said papermaking fibers comprising at least about 10 dry weight percent modified wet-resilient fibers selected from the group consisting of chemically cross-linked cellulose fibers, heat-cured cellulosic fibers, mercerized fibers and sulfonated pulp fibers; (b) partially dewatering the wet web to a consistency of about 15 percent or greater; (c) compressing the partially dewatered web in a high intensity extended nip press to further dewater the web to a consistency of about 35 percent or greater; and (d) final drying the web, wherein the Bulk of the dewatered web prior to final drying is greater than (−0.02C+3.11), wherein "C" is the consistency of the web leaving the high intensity extended nip press, expressed as percent dryness, and Bulk is expressed as cubic centimeters per gram.

2. The method of claim 1 wherein the consistency of the web leaving the high intensity nip press is from about 40 to about 70 percent.

3. The method of claim 1 wherein the Bulk of the dewatered web leaving the high intensity extended nip press is about (−0.032C+3.78) cubic centimeters per gram or greater.

4. The method of claim 1 wherein the Bulk of the dewatered web leaving the high intensity extended nip press is about (−0.02C+3.52) cubic centimeters per gram or greater.

5. The method of claim 1 wherein the Bulk of the dewatered web leaving the high intensity extended nip press is about (−0.03C+4.28) cubic centimeters per gram or greater.

6. The method of claim 1 wherein the modified wet-resilient fibers are chemically cross-linked cellulosic papermaking fibers.

7. The method of claim 1 wherein the modified wet-resilient fibers are heat-cured cellulosic papermaking fibers.

8. The method of claim 1 wherein the modified wet-resilient fibers are sulfonated cellulose fibers.

9. The method of claim 1 wherein the amount of modified wet-resilient fibers is from about 20 to about 80 percent.

10. The method of claim 1 wherein the amount of modified wet-resilient fibers is from about 30 to about 60 percent.

11. The method of claim 1 wherein the web is dewatered in the high intensity extended nip press to a consistency of from about 40 to about 70 percent.

12. The method of claim 1 wherein the web is dewatered in the high intensity extended nip press to a consistency of from about 50 to about 65 percent.

13. The method of claim 1 wherein the Bulk of the web leaving the high intensity extended nip press is from about 5 to about 50 percent greater than the Bulk of a web consisting of a 50/50 weight percent blend of eucalyptus and northern softwood kraft fibers produced under the same conditions.

14. The method of claim 1 wherein the Bulk of the web leaving the high intensity extended nip press is from about 10 to about 40 percent greater than the Bulk of a web consisting of a 50/50 weight percent blend of eucalyptus and northern softwood kraft fibers produced under the same conditions.

15. The method of claim 1 wherein the Bulk of the web leaving the high intensity extended nip press is from about 20 to about 30 percent greater than the Bulk of a web consisting of a 50/50 weight percent blend of eucalyptus and northern softwood kraft fibers produced under the same conditions.

16. The method of claim 1 wherein the dewatered web of step (c) is transferred from the high intensity extended nip press to a first transfer fabric and thereafter rush transferred to a second transfer fabric traveling at a speed from about 5 to about 30 percent slower than the first transfer fabric.

17. The method of claim 16 wherein the rush transferred web is adhered to a Yankee dryer, dried and creped.

18. The method of claim 16 wherein the rush transferred web is transferred to a throughdrying fabric and through-dried.

19. A method for making a bulky tissue sheet comprising: (a) depositing an aqueous suspension of papermaking fibers onto a forming fabric to form a wet tissue web; (b) partially dewatering the wet web to a consistency of about 15 percent or greater; (c) compressing the partially dewatered web in a high intensity extended nip press to further dewater the wet web to a consistency of about 35 percent or greater; (d) transfering the dewatered web to a first transfer fabric; (e) transfering the dewatered web from the first transfer fabric to a second transfer fabric travelling at a slower speed than the first transfer fabric to increase the Bulk of the wet web; and (f) drying the web.

20. The method of claim 19 wherein the web is transferred from the second transfer fabric to a Yankee dryer, dried and creped.

21. The method of claim 19 wherein the web is transferred from the second transfer fabric to a throughdrying fabric and throughdried.

* * * * *